US006134752A

United States Patent [19]

Göhler et al.

[11] Patent Number: 6,134,752

[45] Date of Patent: Oct. 24, 2000

[54] LOADING MECHANISM FOR THE UPPER ROLLS OF A DRAFTING MECHANISM

[75] Inventors: Wolfgang Göhler, Lenting; Armin Brunner, Elsendorf, both of Germany

[73] Assignee: Rieter Ingolstadt Spinnereimaschinenbau AG, Ingolstadt, Germany

[21] Appl. No.: 09/255,994

[22] Filed: Feb. 23, 1999

[30] Foreign Application Priority Data

Feb. 25, 1998 [DE] Germany ..... 198 07 801

[51] Int. Cl.[7] ..... D01H 5/54

[52] U.S. Cl. ..... 19/272; 19/258; 19/260; 19/267

[58] Field of Search ..... 19/236, 239, 240, 19/245, 248, 250, 258, 260, 261, 262, 263, 265, 266, 267, 268, 269, 270, 271, 272, 274, 295

[56] References Cited

U.S. PATENT DOCUMENTS 3,310,847 3/1967 Aurich ..... 19/258

3,409,946 11/1968 Whitehurst ..... 19/258

4,512,061 4/1985 Hartmannsgruber et al. ..... 19/239

*Primary Examiner*—Michael A. Neas

*Assistant Examiner*—Gary L. Welch

*Attorney, Agent, or Firm*—Dority & Manning

[57] ABSTRACT

A pneumatically energized loading mechanism for a drafting device is proposed for loading the upper rolls of the device. This mechanism possesses pneumatic cylinders which subject the upper rolls to a force, which acts from a holder plate (4) for the securement of the cylinder (2). The support is effected by a stop plate (200), which acts in unison with holder plate (4). The cylinder (2) possesses a guide surface (201) positioning the cylinder on the support (4). The cylinder (2) exhibits a piston with a circular cross-section and is comprised of plastic. The cylinder (2) is affixed to the holder (4) by a securement means (20). By the support of the cylinder (2) on the holder (4), the securement means (20) need accept no force engendered by the piston. The cylinder (2) simultaneously forms a passage for a current bus which serves as the power cutoff of the drafting device when fiber windup difficulties arise.

14 Claims, 3 Drawing Sheets

LOADING MECHANISM FOR THE UPPER ROLLS OF A DRAFTING MECHANISM

BACKGROUND OF INVENTION

The present invention is concerned with a loading mechanism for the upper rolls of a drafting zone used in textile processes in which the load on the upper rolls is created by using a pressurized cylinder. DE 38 14 340 A1 has placed into common knowledge a loading mechanism in which, to achieve sufficient pressure application onto the upper rolls, the pistons of the said loading mechanism possess a quadrilateral form. The minimal spatial distance of the loaded rolls at right angles to their respective axes should be held as small as possible. The pistons therein described require a membrane, in order to seal them off in relation to their cylinder wall.

OBJECTS AND SUMMARY OF THE INVENTION

It is therefore a principal object of the present invention is to create a loading mechanism, which avoids the deficiencies of the present state of the technology, and is simple, favorably priced, saves space, and can be versatile in its design.

Additional objects and advantages of the invention will be set forth in part in the following description, or may be obvious from the description, or may be learned through practice of the invention.

The loading mechanism of the present invention demonstrates that the pressure cylinder can be simple and economical to manufacture, particularly by means of injection molding and that the said cylinder can be easily mounted on a holder. The cylinder is slidingly positioned in its axial direction to the rolls of the drafting zone along a guide installed for adjustment. The forces to which the drafting zone is subjected react against structural support without having the internal members of the cylinder carrying additional stresses.

By these measures, the fastenings of the cylinders can be designed to be easily and quickly released. The positioning of the cylinder is thereby simplified. Undesirable distortions by the application of piston force can be easily prevented by means of the stop plates.

It is especially advantageous to manufacture the cylinder, even partially, of plastic with preference given to injection molding.

Again, it is especially advantageous to build the cylinder of several parts, since it can be easily done and substantially simplifies an installation. The most favorable circumstances arise when the cylinder is comprised of two pieces, whereby the one part contains the cylinder space and the other a guide for the piston rod. The parts of the cylinder are bound to one another by means of connection elements, so that the cylinder is a complete, integral structural component. For this purpose, connection elements, for instance, threaded elements, were implanted. In the injection molding of the cylinder, one or more threaded bushings were placed as inserts. Bonding between several parts of the cylinders was made by clip connections. Such connections are easily made and mounted. In a preferable embodiment of the invention, the cylinder possesses a connection for affixing itself to the upper roll. This is also designed in common with a supporting plate. In a further embodiment of the invention, the cylinder assembly possesses a holder, which forms or accommodates a cleaning lip for the upper roll.

Within the cylinder, a power cut-off device for the stretch works is installed. For this operation, the switching off device is protected from accumulation of contamination. The cutoff device is comprised of a switch for the interruption of an electrical current. In a preferred improvement, the switch arrangement possesses a contacting member with which it establishes an electrical contact with an electrical current bus of the textile machine, whereby this contact can be made on various parts of a current bus and thereby a sliding contact is established. The current carrying member is designed in the form of a rod, since this arrangement has simultaneous connectability to a plurality of loading mechanisms. In an improvement, two holders are provided for the cylinder, so that the cylinder can be located between the two holders. In a further improvement of the invention, the cylinder possesses a plurality of guide surfaces, whereby the cylinder is capable of simultaneous interaction with several holders.

In a development of the invention, the cylinder possesses one or more guide surfaces, which are generally vertically aligned to one or more stop plates.

In another development of the invention, the contacting stop plate is placed upon that area of the cylinder in proximity to the upper rolls, whereby the holder can be especially simply made and the cylinder can be equally simply adjusted into the most effective position to the upper roll corresponding to cylinder. In another embodiment of the invention, the stop plate is located on that side of the cylinder remote from the upper roll corresponding to the cylinder. In this latter case, fastening elements, which hold a multi-component cylinder together, are not subjected to the forces that are exercised by the piston on the bottom rolls. For this purpose, the holder possesses a support plate to which the stop plate of the cylinder can be fastened.

In another embodiment of the invention, the pressurized fluid is compressed air, since this is easier to manipulate than a hydraulic fluid. The compressed air is applied with a gauge pressure of less than 7 bar, since this pressure requires no special measures and is available more frequently than high pressure compressed air. The piston of the cylinder of the loading mechanism exhibits a circular cross-section, since this design essentially simplifies the manufacture thereof. In a development of the invention, the diameter of the piston is less than the diameter of the upper rolls, whereby it may be more easily assured that the axis separation distances, in the case of a plurality of drafting zones, can be held at a small value. In this matter, it is favorable if the length of the cylinder, as seen at right angles to the axis of the corresponding roll (or diameter), is provided with offsets in amount of 0 to 10 mm. Further advantageous embodiments of the invention are described in the subordinate claims.

BRIEF DESCRIPTION OF THE DRAWINGS

In the following the invention is described in greater detail with reference to the drawings. There is shown in.

DETAILED DESCRIPTION

Figure 1:
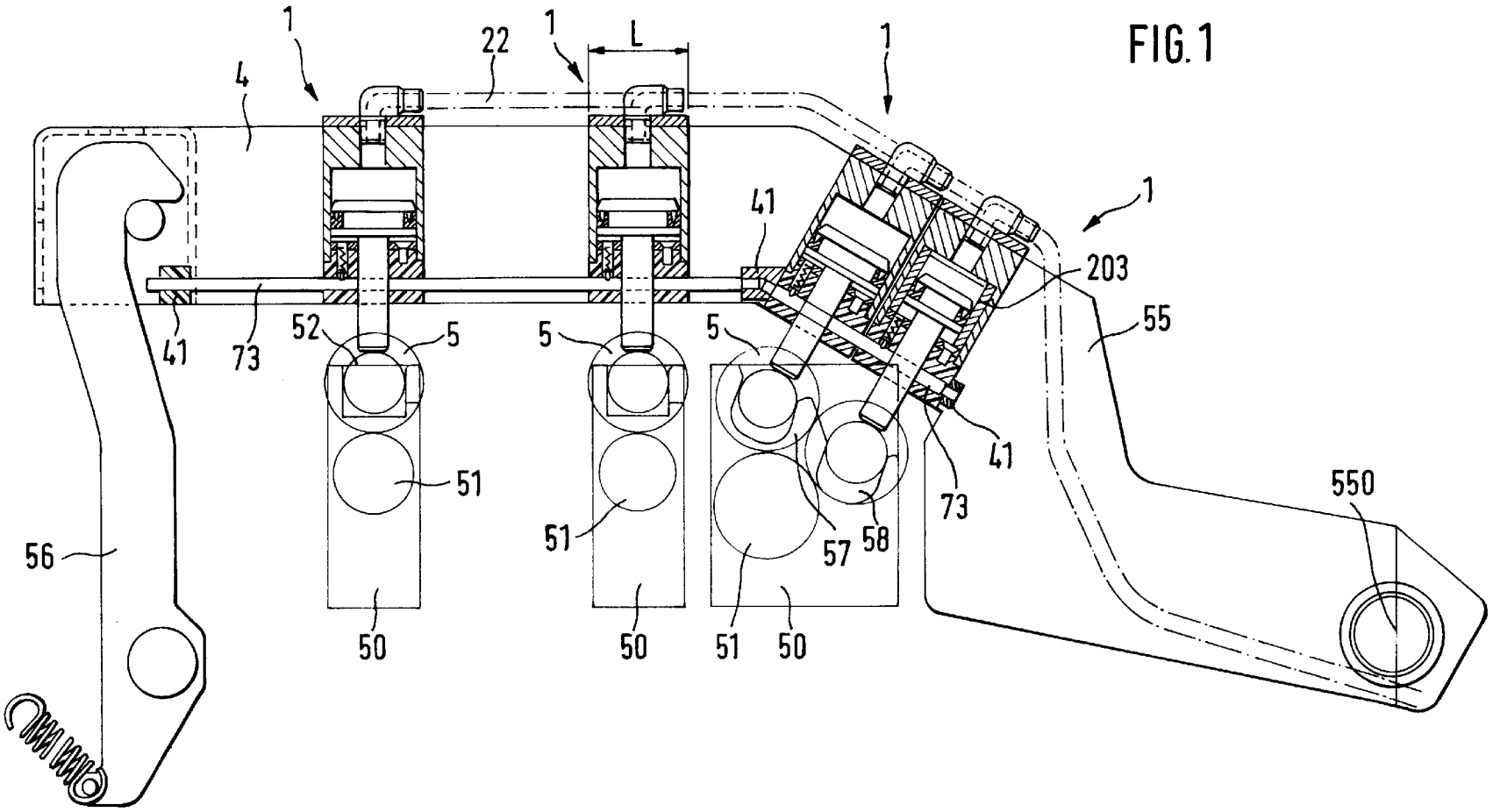
FIG. 1 a pressuring arm for drafting zone with a plurality of loading mechanisms.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

FIG. 1 shows, in a sectioned schematic example, the loading mechanism installed on a loading arm for the upper rolls of a drafting zone. The loading arm 55 possesses two holders 4 (see also FIG. 2). Only one such holder can be seen in FIG. 1. The drafting zone has three upper rolls (5), which lie upon corresponding lower rolls 51 and are secured with bearings in the base supports 50 of the structural framing. In a conventional manner, axle extensions of the upper rolls of the drafting zone are carried in bearings (52) and are loaded by a loading means, being thereby pressed against the lower rolls.

For this purpose, the loading arm 55 is equipped with the two arms, of which one exerts the loadings for one side of the upper rolls 5 and the other serves the same purpose for the extended opposite ends of the corresponding upper rolls. Each of these loading arms is equipped with two holders 4, between which holders, the loading mechanisms 1 are carried (see FIG. 2). The section in FIG. 1 is so devised, that it runs through the loading mechanisms 1 of the one side of the drafting zone.

Experience dictates that the spatial intervals of the upper rolls to one another on a drafting zone must be designed to be adjustable, since, in accord with the characteristics of the fiber material to be drafted, different separating distances are required. For this purpose, the base supports 50 in the drafting zone are slidingly movable at right angles to the axes of the upper and lower rolls. Accordingly, the loading mechanism of the corresponding upper rolls must accommodate this movement. For this purpose, the loading mechanisms in accord with the invention are also installed slidably on the holder 4 of the loading arms 55. Principally, the exit roll 57 of the drafting zone need not be moved, since, at this point, the fiber band leaves the drafting zone. On the lower roll 51 of the exit pair of rolls, there is, in addition, a turn-around roll 58 installed, which changes the direction of the fiber band as it leaves the drafting zone. For the sake of simplicity, the loading mechanisms 1 of the present invention are all of the same construction. The pressing force on the upper rolls is controlled by the pressure of the pressure-medium, which is communicated to the loading mechanisms 1 by means of the pressure lines 22. By means of this pressure of the pressure-medium, the pressing force for each upper roll can be regulated individually. It is recommended to subject the exit roll 57 and the turn-around roll 58 to the same pressure. However, to achieve different forces with the same pressure for the turn-around roll and exit roll in this present embodiment, the piston area of the loading mechanism 1 for the turn-around roll 58 is less than that of the exit roll 57, so that a smaller force is exercised on the said turn-around roll 58. This preferred arrangement is reached, in that, in the cylinder space of the normal loading mechanism, which cylinder space is common for upper rolls, a bushing 203 is inserted that diminishes the inside diameter and accordingly, a smaller piston is used, which correspondingly produces less force. This arrangement may also be preferred for the loading mechanisms of the remaining upper rolls of a machine, so that in spite of one single pressure of the pressure-medium, different pressing forces can still be exerted against different upper rolls.

The loading arm 55 is set in bearings 550, which furnish a centerpoint of rotation, so that said loading arm 55 can be opened, whereby the drafting zone is made accessible.

In the closed position, a securing hook 56 locks in the loading arm 55, so that the force can be brought to bear on the upper rolls 5.

Figure 2:
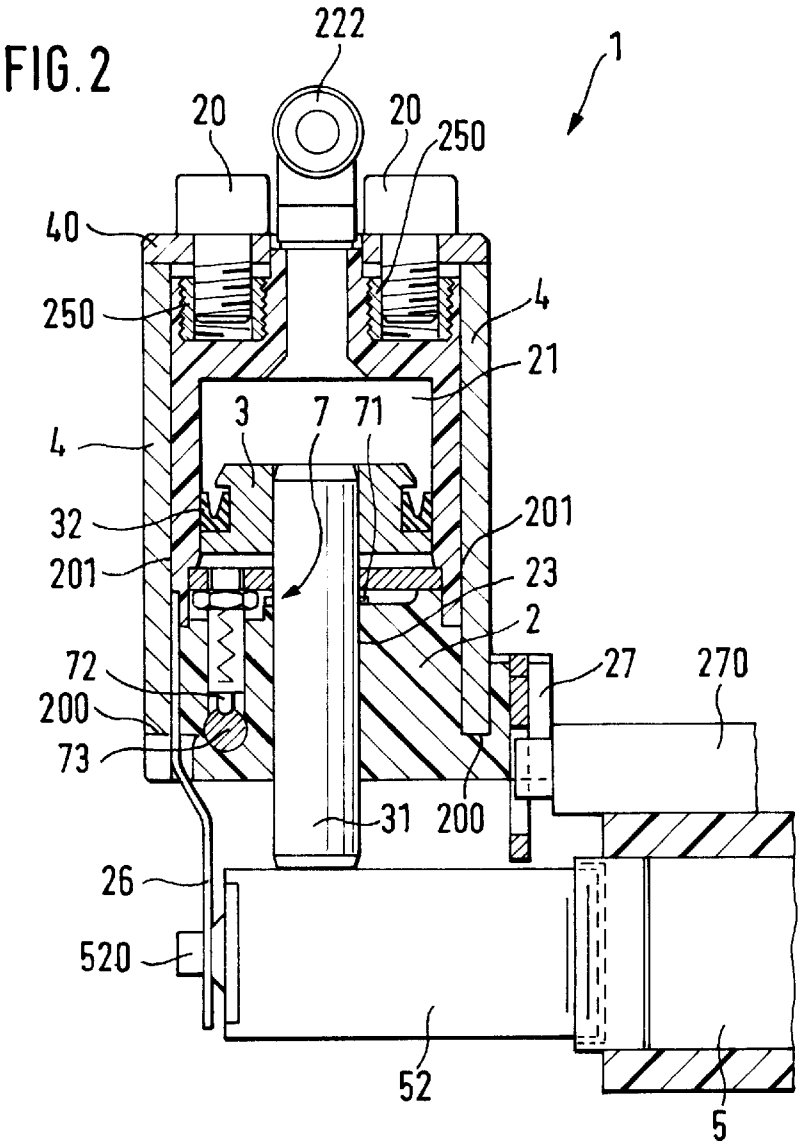
FIG. 2 a loading mechanism as in FIG. 1, sectioned in the area of the piston of said loading mechanism.

FIG. 2 shows a profile section through a loading mechanism 1 in accord with the invention seen at a 90° rotation to the plane of FIG. 1. The section is taken midway through the upper roll and the loading mechanism. The loading mechanism is comprised of a cylinder 2 in which a piston 3 is placed. This assembly is subjected to force from a pressure medium in the cylinder space 21, which force is then transmitted through a piston rod 31 to the end bearing block 52 of the upper roll 5. On the other end (not shown), the upper roll has, an opposite end bearing block, which is likewise loaded by a loading mechanism. The cylinder 2 is designed in two parts, wherein the upper part forms the cylinder space 21 and the lower part the guide 23 for the piston rod 31. The piston 3 is sealed off from the inner wall of the cylinder 2 by a piston ring 32, which is designed as a lip type seal. The inner wall of the cylinder 2 is appropriately lubricated in the zone of the cylinder space 21, so that a smooth slide of the piston ring 32 is made possible. The piston rod 31 and the piston 3 are bound to one another by means of a compression fit. The upper, that is, the part of the cylinder 2 remote from the upper roll 5, is affixed to the lower part of the cylinder 2 by means of fastening elements 25 (see FIG. 3).

The fastening of the loading mechanism 1 onto the loading arm 55 is done by clamps on the left and right holders 4. For this purpose, the cylinder 2 possesses stop plates 200 with which the cylinder 2 abuts the two holders 4 of the loading arms 55. At the same time, the cylinder 2 is drawn against the stop plates 200 with securement means 20. These securement means, working together with the cylinder on the oppositely situated side, bring about a clamping retention. For this purpose, a fastening plate 40 is set against the holder 4 onto which the securement means 20 fasten. The securement means 20 threadedly engage themselves in the tapped bushings 250, which have been placed in the cylinder 2.

In the case of a preferred cylinder 2, which is comprised of injection molded plastic, the tapped bushings 250 are preset as inserts in the original plastic mold. In this way, an assured fastening becomes possible. Opposite the piston 3, on the cylinder 2 is located a pipe connection fixture 222 for a pressure medium line.

In addition, on cylinder 2 is found a support member 26, which connects to the upper roll 5. This support member 26 is comprised of a spring steel shaped plate. Into a longitudinal opening of the spring steel shaped plate, penetrates a protruding pin 520 of the bearing assembly of the upper roll 5. Upon the swinging away of the loading arm 55, along with the loading mechanism 1 of the upper roll 5, this support member 26 is also lifted away. Advantageous for the loading mechanism 1, is the inclusion of a holding plate 27 on the cylinder 2 for the securement of a lip 270 for the cleaning of the upper roll. This cleaning lip 270 also accompanies the said loading arm 55 when the latter is swung away. The holder 27 possesses a longitudinal opening into which a projection of the cleaning lip is inserted.

Figure 3:
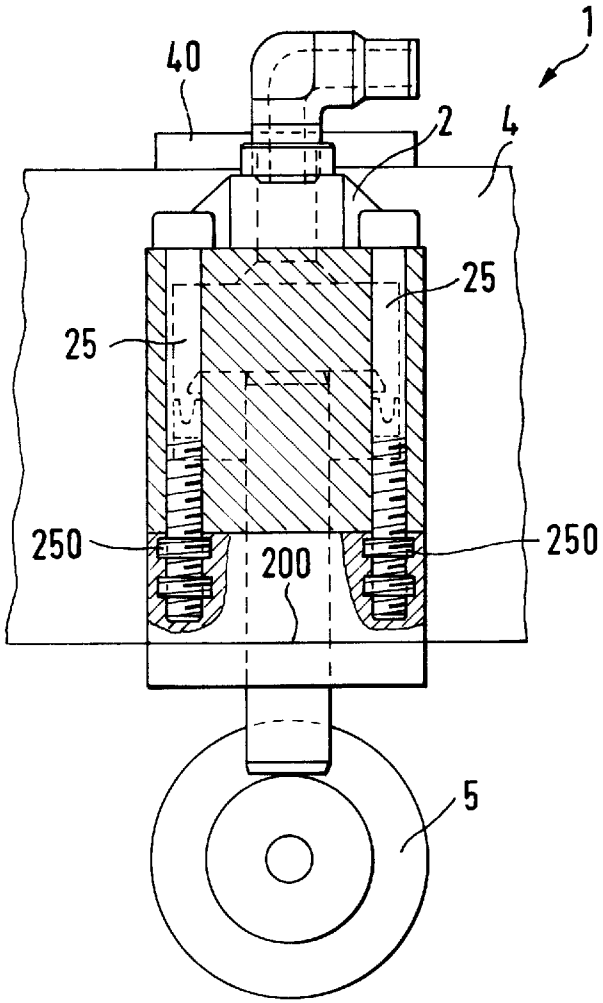
FIG. 3 the loading mechanism of FIG. 2, sectioned in the area of loading mechanisms having the multi-part cylinders.

FIG. 3 depicts, schematically, a section through a loading mechanism, which is in accord with the invention, wherein the section is made at 90° to the axis of the upper roll 5, and lies in the plane in which the fastening elements 25 are found. Against the holder plate 4 lies the fastening plate 40, which is pulled up against the cylinder 2 by the securement means 20 (see FIG. 2). The securement means 20, which are threaded bolts, bind the lower part and the upper part of the cylinder 2 together and securement means 20 are threadedly seated in the tapped bushings 250, which have been co-molded as inserts in the injection molding of the cylinder 2. With its side proximal to the upper roll, the cylinder 2 lies above the stop plate 200 on the holder 4. The piston pressure applied to the upper roll is, by the just described arrangement, backed up by the holder 4. For the sliding movement of the cylinder 2, the securement means 20 (see FIG. 2) are loosened, whereby the fastening plate 40, together with the cylinder 2, can be slidingly moved on its guide surface along the holder 4.

Figure 4:
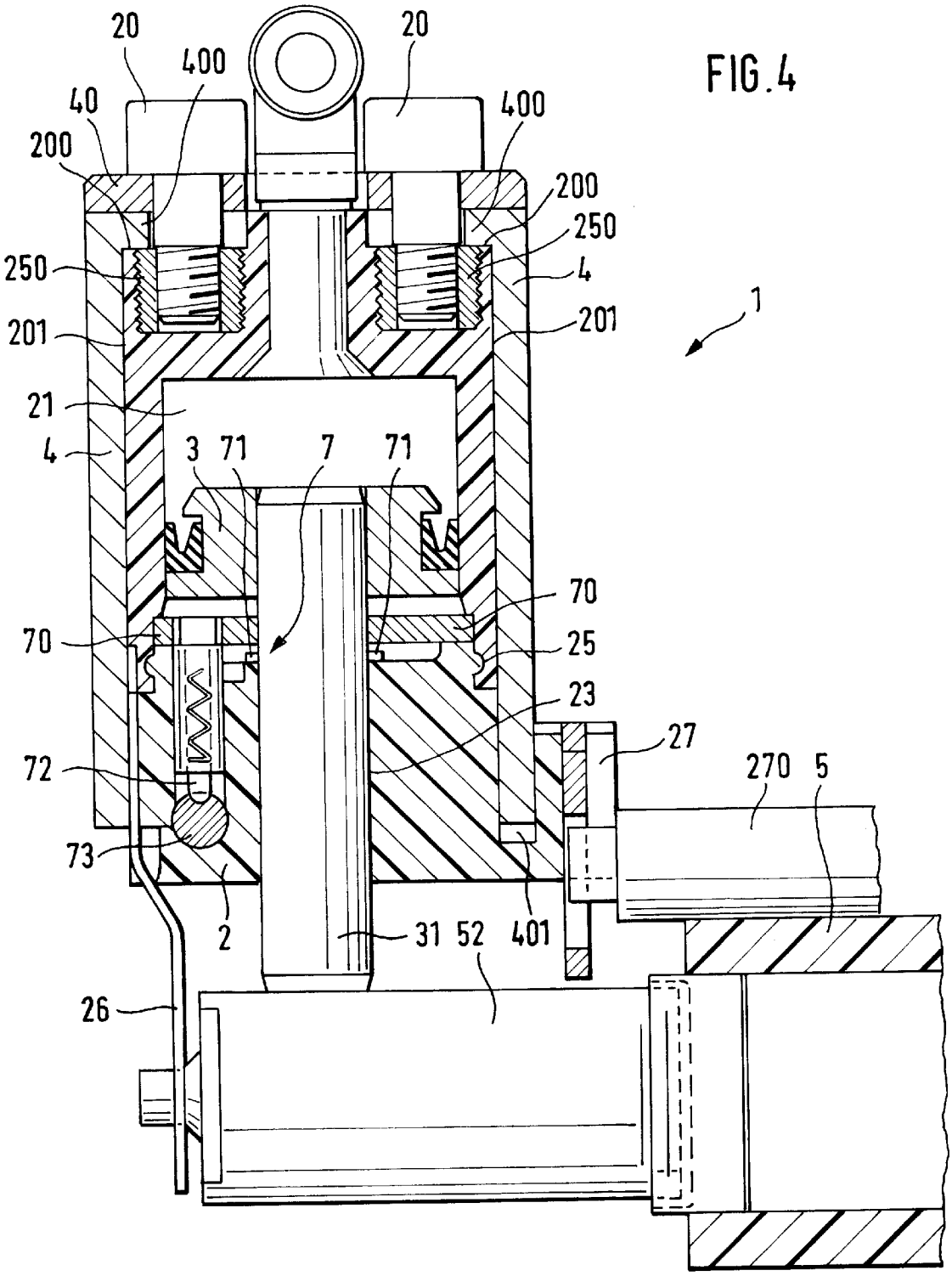
FIG. 4 a loading mechanism for a spinning machine for the loading of the upper rolls of a drafting zone, in section.

FIG. 4 shows a loading mechanism designed in accord with the invention in which the two parts of the cylinder 2 are bound to one another by a clip arrangement. This arrangement is possible because the cylinder 2 with its stop plate 200 supportingly abuts on that side of the holder 4, which is remote from the upper roll 5.

To this end, the holder 4 possesses a stop plate 400, so that the force arising from piston 3 and transmitted to the bearing 52 acts through that portion of the cylinder 2 that contains the cylinder space 21 directly on the holder 4. The connection between the portion of the cylinder 2, which contains the cylinder space 21, and the portion containing the guide 23 for the piston rod 31, needs, under this arrangement, to accept no forces. The corresponding path of the force in FIGS. 2 and 3 is taken over by the threaded bolts 25.

In FIGS. 2 and 3, the cylinder 2 is secured against slipping by the fastening plate 40 and the securement means 20 on the holder 4. The securement means 20 likewise accepts here, no force which arises on the bearing 52 from the backup of the piston 3. In the area of the holding plate 27 in FIG. 4, a sufficient spatial interval 401 is provided between the holding plate 4 and the cylinder 2, so that the clip connection 25 is not overstressed. The cylinder 2 lies with its guide surface 201 slidably placed on the holder 4, so that upon adjustment of the spatial interval of the axes, the loading mechanism may be pushed along the holder 4. Simultaneously, the guide surface in the axial direction of the upper roll takes over the positioning of the cylinder 2 in relation to the holder 4, and thereby also in relation to the upper roll 5. On its upper side, the fastening plate 40 has an opening through which penetrates a pipe fitting 222 on the cylinder 2, in order to supply the cylinder space 21 with a pressurized medium.

The cut-off device 7 serves to control the textile machine, that is, to send such a signal for control to be activated. Upon the installation of the loading mechanism 1 on a drafting zone, the device provides recognition of the position of the piston 31, in order, with the help of this signal, to shut down the drafting.

At the same time, the loading on the upper roll 5 of the drafting zone is removed. During the operation of drafting, there can be a repetitive occurrence of the so-called winding build-up on the upper rolls, wherein fibers wrap themselves around the upper roll 5. This leads to a critical operational situation, because the bearings of the upper and lower rolls are immensely overloaded.

Furthermore, the outer surfaces of the upper rolls can suffer damage since the windings are wound extremely tightly around the upper rolls. These windings can be loosened only with great difficulty. The cut-off device 7 generates a signal, that shuts down the drafting, so that no further fibers can come into the drafting zone and at the same time, the loading on the upper rolls is relieved, so that the winding cannot further consolidate. In the case of a loading mechanism designed in accord with the invention, the relieving of the loading on the upper rolls is made (very easily) possible, because the pressure is taken off the upper roll 5 by means of air release from the cylinder space 21.

The cut-off device 7 is comprised essentially of a switch 71, which can assume two positions. In one position, the switch 71 lies on a contact plate 70. In the other position, the switch finds itself between contact plate 70 and cylinder 2. The switch 71 is designed as an electrically conductive plate, which, by means of a sliding fit, is movably affixed to the piston rod. Upon movement of the piston rod 31, the switch slides along the piston rod. If the loading mechanism 1 set upon the bearing 52 is without pressure in the cylinder space 21, then the piston rod slides in the direction away from the bearing 52, whereby the switch 71 impacts against the contact plate 70 as the piston rod upwardly slides. If now, for starting operation, the loading mechanism is supplied with pressure in the cylinder space 21, then the piston rod 31 moves in the direction of the bearing 52 of the upper roll 5 and with this motion, takes the switch 71 with it. The switch 71 then lies on the cylinder 2. The cylinder 2 is comprised of a non-conducting plastic material, so that no electrical connection establishes itself between the bearing 52 and the electrical current bus 73. The contact plate 70 has no electrical connection to the piston rod 31, but does stand electrically in communication with the contact rod 72.

This rod 72 is electrically conducting and connected to the current bus 73. A spring has been arranged with the contact rod 72, which presses contact rod 72 onto the current bus 73. By these means, assurance is provided that the loading mechanism 1 can be slidingly pushed into positions on the holder 4 without the difficulty of renewing an electrical contact.

Further, assurance is provided that tolerances in the positioning of the bus 73 on the holder 4 have no influence on the electrical contact. The current bus 73 installed in cylinder 2 is electrically insulated, since the cylinder 2 is molded of plastic, which is not electrically conductive.

FIG. 1 shows the current bus 73 in its position on the holder 4. It is designed as a two part component and fastened to the holder 4 and insulated therefrom by means of insulators 41. In the area of the loading mechanism assigned to the exit roll 57, the current bus 73 makes, in the corresponding insulator 41, a sharp bend. The loading mechanism 1 for the exit roll 57 and turn-around roll 58 are not slidingly moved, so that the sharp bend does not interfere. The current bus is connected with the control (not shown) of the of the textile machine by means of an (again not shown) electrical connection.

In the case of a windup on one of the upper rolls, the upper roll 5 is pressed away from its lower roll against the pressure of the piston 3. The piston moves itself then, with its piston rod in a direction away from said upper roll 5. Since the said switch 71 first moves itself with the piston rod 31, it impacts the contact plate 70, whereby the switch 71 completes the circuit and an electrical connection between the textile machine and the electrical connection (not shown) of the current bus 73 is established.

Favorable dimensions for the invented loading mechanism 1 orient themselves to the diameter of the corresponding upper rolls 5 of the drafting zone on which the loading mechanism is to be installed. In order to install the upper rolls with the minimum possible spatial intervals between one another, the cylinder has a length L at 90° to the axis of the upper roll, which corresponds to the diameter of the upper roll.

An offset projection added to this diameter of up to 10 mm is preferred. By this means, a plurality of cylinders can be arranged in one plane along a loading arm 55. An axial displacement, as is established by the current state of the technology, (DE 38 14 340 A1) is not necessary. The bearings of the upper rolls need not be greater in axial direction than the breadth of the loading mechanism.

The use of compressed air as a fluid for pressurizing the piston of the loading mechanism is particularly advantageous in comparison to liquid pressure media. The range of possible applications for this loading mechanism 1 is especially great, if it is so designed that it can be operated with compressed air not exceeding 7 bar. Loading mechanisms of theis type are available practically universally in the production centers of the textile industry. The installation of a piston 3, which has a circular base of diameter less than that of the upper roll and is engaged with compressed air less then 7 bar gauge, allows the achievement of sufficient force with simultaneously, favorable dimensioning of the loading mechanism. In this matter, values appearing between 75 and 85% of the diameter of the upper roll are particularly to be preferred.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A loading mechanism for use in a textile machine drafting zone for applying force to upper drafting rolls in the drafting zone, said loading mechanism comprising:

a loading arm disposable above bearing arrangements for the upper drafting rolls in the drafting zone, said loading arm further comprising a cylinder holder;

a pressurizable cylinder carried within said cylinder holder and variably positionable therealong, said cylinder defining a cylinder space attachable to a source of pressurized medium, and further comprising a piston rod moved by the pressurized medium; and a securement device operably configured with said holder and said cylinder to releasably secure said cylinder at a desired position along said holder, and whereby upon release of said securement device, said cylinder is positionable along said holder to a different desired position.

2. The loading mechanism as in claim 1, wherein said cylinder further defines a generally vertical guide surface defined on an outer surface thereof, said guide surface bearing against said holder and allowing said cylinder to be variably positioned along said holder.

3. The loading mechanism as in claim 2, further comprising a stop plate defined on said holder against which said cylinder bears, said stop plate defined in a plane generally perpendicular to said vertical guide surface.

4. The loading mechanism as in claim 3, wherein said cylinder bears against said stop plate at an end of said cylinder proximate the upper drafting roll.

5. The loading mechanism as in claim 3, wherein said cylinder bears against said stop plate at an end of said cylinder proximate said cylinder space.

6. The loading mechanism as in claim 1, wherein said holder is defined by generally parallel and longitudinally extending sides of said loading arm, said cylinder variably positionable along and between said sides.

7. The loading mechanism as in claim 1, wherein said cylinder is formed from at least two connected components, wherein one said component defines said cylinder space and the other said component defines a piston rod guide for said piston rod.

8. The loading mechanism as in claim 7, wherein said connected components are held together by at least one screw.

9. The loading mechanism as in claim 8, wherein at least one of said components contains a threaded insert for receipt of said screw.

10. The loading mechanism as in claim 7, wherein said components are formed from a plastic material.

11. A loading mechanism for use in a textile machine drafting zone for applying force to upper drafting rolls in the drafting zone, said loading mechanism comprising:

a loading arm disposable above bearing arrangements for the upper drafting rolls in the drafting zone, said loading arm further comprising a cylinder holder;

a pressurizable cylinder carried within said cylinder holder and variably positionable therealong, said cylinder defining a cylinder space attachable to a source of pressurized medium, and further comprising a piston rod moved by the pressurized medium;

a securement device operably configured with said holder and said cylinder to releasably secure said cylinder at a desired position along said holder, and whereby upon release of said securement device, said cylinder is positionable along said holder to a different desired position;

wherein said cylinder further defines a generally vertical guide surface defined on an outer surface thereof, said guide surface bearing against said holder and allowing said cylinder to be variably positioned along said holder;

a stop plate defined on said holder against which said cylinder bears, said stop plate defined in a plane generally perpendicular to said vertical guide surface; and further comprising a retaining member attachable to said holder by said securement device, said cylinder disposed between said stop plate and said retaining member within said holder.

12. A loading mechanism for use in a textile machine drafting zone for applying force to upper drafting rolls in the drafting zone, said loading mechanism comprising:

a loading arm disposable above bearing arrangements for the upper drafting rolls in the drafting zone, said loading arm further comprising a cylinder holder;

a pressurizable cylinder carried within said cylinder holder and variably postionable therealong, said cylinder defining a cylinder space attachable to a source of pressurized medium, and further comprising a piston rod moved by the pressurized medium;

a securement device operably configured with said holder and said cylinder to releasably secure said cylinder at a desired position along said holder, and whereby upon release of said securement device, said cylinder is positionable along said holder to a different desired position; and further comprising a cleaning lip device configured on said cylinder so as to contract the upper drafting roll upon positioning of said cylinder along said holder.

13. A loading mechanism for use in a textile machine drafting zone for applying force to upper drafting rolls in the drafting zone, said loading mechanism comprising:

a loading arm disposable above bearing arrangements for the upper drafting rolls in the drafting zone, said loading arm further comprising a cylinder holder;

a pressurizable cylinder carried within said cylinder holder and variably postionable therealong, said cylinder defining a cylinder space attachable to a source of pressurized medium, and further comprising a piston rod moved by the pressurized medium;

a securement device operably configured with said holder and said cylinder to releasably secure said cylinder at a desired position along said holder, and whereby upon release of said securement device, said cylinder is positionable along said holder to a different desired position; and further comprising an electrical cut-off device configured with said cylinder, said cut-off device interrupting electrical power to the textile machine upon a condition sensed by said cylinder.

14. The loading mechanism as in claim 13, wherein said holder further comprises an electrical current bus, said cut-off device comprises an electrical contact in sliding contact along said bus as said cylinder is positioned along said holder.

* * * * *